United States Patent [19]

Staff

[11] 4,384,532

[45] May 24, 1983

[54] TABLE EXTENSION FOR THE HANDICAPPED

[76] Inventor: Arthur B. Staff, R.D. #1, P.O. Box 238, Slippery Rock, Pa. 16057

[21] Appl. No.: 202,497

[22] Filed: Oct. 31, 1980

[51] Int. Cl.[3] ..... A47B 1/04

[52] U.S. Cl. ..... 108/72; 108/93; 108/90; 108/96; 312/27; 312/266

[58] Field of Search ..... 108/72, 93, 76, 96, 108/90, 108, 97, 28, 45, 72; 312/266, 24, 27, DIG. 33; 248/421

[56] References Cited

U.S. PATENT DOCUMENTS

| | | | |
|---|---|---|---|
| 236,589 | 1/1881 | Hoffmeir | 108/63 |
| 1,167,905 | 1/1916 | Kreczkowski | 108/63 |
| 1,303,697 | 5/1919 | McLaughlin | 312/266 |
| 1,676,025 | 7/1928 | Hanson | 108/67 |
| 1,952,621 | 3/1934 | Bromley | 108/72 |
| 1,985,620 | 12/1934 | Raphael | 108/72 |
| 1,992,435 | 2/1935 | Labadie et al. | 312/266 X |
| 2,168,813 | 8/1939 | Vinding | 108/63 |
| 2,263,816 | 11/1941 | Nonnast | 108/72 |
| 2,577,724 | 12/1951 | Weller | 108/72 |
| 2,852,325 | 9/1958 | Fosnaugh | 108/63 |
| 2,868,597 | 1/1959 | Morrison | 108/71 |
| 2,926,980 | 3/1960 | Ricci | 108/72 X |
| 3,016,650 | 1/1962 | Magers | 108/32 |

FOREIGN PATENT DOCUMENTS

| | | | |
|---|---|---|---|
| 9674 | 11/1902 | Austria | 108/72 |
| 35686 | 2/1966 | Finland | 108/72 |
| 1211255 | 10/1959 | France | 108/72 |
| 328244 | 8/1935 | Italy | 312/266 |

*Primary Examiner*—James T. McCall

*Attorney, Agent, or Firm*—Webb, Burden, Robinson & Webb

[57] ABSTRACT

A table extension suitable for use by a person confined to a wheelchair which is mountable beneath an existing table, and also a table in combination with such a table extension. The Table extension includes a pair of opposed spaced side frame members forming a housing, means for securing the housing to the underside of a table top, a first planar member, support means in each side frame member for slidably supporting the first planar member, a second planar member disposed above and substantially parallel to the first planar member, and locking hinge means connecting the planar members and providing for movement of the planar members from a collapsed position within the housing to an extended position wherein the second planar member is raised to a position substantially at the same level as the table top.

14 Claims, 6 Drawing Figures

TABLE EXTENSION FOR THE HANDICAPPED

BACKGROUND (1) Field of the Invention

This invention pertains to the furniture field, to devices for providing an extension to a table top or other planar surface, and more particularly to table extensions which may be mounted to an existing table.

(2) Description of the Prior Art

Because of the interference from the table legs and cross supports beneath a table, those handicapped persons confined to a wheelchair have a difficult, and often impossible, time maneuvering their wheelchairs underneath a standard table. Thus, a standard table presents an obstacle to a handicapped person nearly as great as a set of stairs without a ramp. Conventional table extensions do not alleviate the problems of the handicapped with tables for a variety of reasons.

Table extensions are known that have been built into a table and may be used by a person in a wheelchair once the extension is in place. See, for example, U.S. Pat. Nos. 236,589; 1,167,905; and 2,852,325. However, the complex paths of motion necessary to set these table extensions up cannot be readily performed by a person sitting in a wheelchair. The typical drop leaf extension hangs down low and a handicapped person finds it difficult to move the leaf upward and into a locked position.

It accordingly is an object of the present invention to provide a table extension of relatively simple construction which may be operated easily by a person confined to a wheelchair.

U.S. Pat. No. 2,868,597 discloses a table extension which may be operated by a person confined to a wheelchair. This extension is positioned beneath a table top and may be moved into an extended position by simply pulling the extension straight out from under the table and locking it into place. However, this table extension has the disadvantage of requiring a specific table bottom surface to accommodate the table extension. Therefore, this table extension must be built into the basic design of the table. A person desiring such a table extension would need to purchase an entire table.

It is a further object of the present invention to provide a table extension for handicapped persons which may be attached to an existing table.

SUMMARY OF THE INVENTION

Accordingly, I have invented a table extension which may be mounted beneath an existing table top or other planar surface, or built into an existing table, and easily pulled into place by a person sitting before the table in a wheelchair. My table extension includes a pair of opposed spaced side frame members forming a housing, means for securing the housing to the underside of a table top, a first planar member, support means in each side frame member for slidably supporting the first planar member, a second planar member disposed above and substantially parallel to the first planar member, and locking hinge means connecting the planar members and providing for movement of the planar members from a collapsed position within the housing to an extended position wherein the second planar member is raised to a position substantially at the same level as the table top. The housing may also include one or more cross support members between the frame members, and an upper support member secured to the top of each side frame member to attach the housing beneath the table top. The support means is preferably a longitudinal channel in each frame member which engages one edge of the first planar member. The preferred locking hinge means is a pair of opposed Z-hinges and means on the first planar member for locking the Z-hinges in an open position whereby the planar members are held in the extended position. A handle may be provided on the second planar member for grasping and moving the planar members from the collapsed position to the extended position and vice versa.

DESCRIPTION OF THE PREFERRED EMBODIMENT

Figure 1:
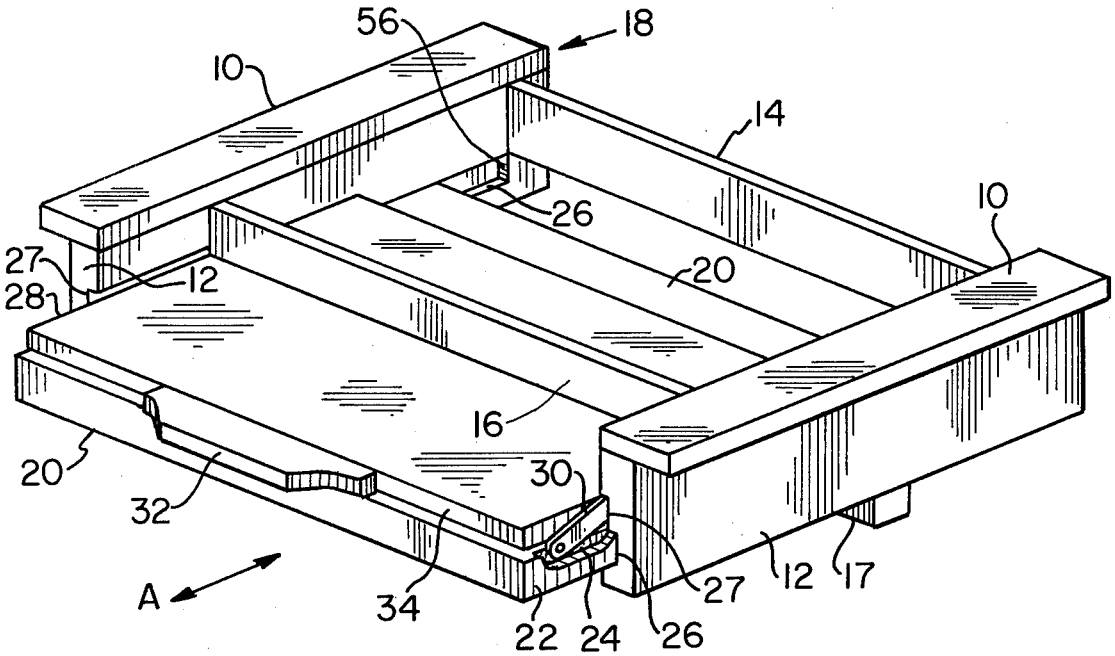
FIG. 1 is a perspective view of the table extension.

Referring to FIG. 1, my table extension, which is preferably made of wood, includes a pair of upper support members 10, a side frame member 12 suspended from each upper support member 10, a pair of spaced cross supports 14 and 16 disposed between the frame members 12 and attached thereto, and a lower support 17 disposed beneath the frame members 12 and attached thereto. Together these elements form a housing 18. A first or lower planar member or board 20 is disposed within the housing 18 between the frame members 12. The outside edge 22 of the lower board 20 engages a support means in each frame member 12. As will be explained in more detail later in connection with FIG. 3, the lower board 20 includes first and second recessed portions 24 and 25. The support means is preferably a first groove or channel 26 running substantially the length of each frame member 12, but may also be an angle iron or the like attached to each frame member 12. The lower board 20 is thus supported in the first channels 26 between the frame members 12 and is adapted to slide in and out of the housing 18 in the direction indicated by the double-headed arrow A.

A second or upper planar member or board 28 is disposed above and parallel to the lower board 20, and also within the housing 18 and between the side frame members 12. A locking hinge means, which preferably includes a pair of Z-hinges 30, is secured between the upper and lower boards 28, 20. A handle 32 may be provided on the front edge 34 of the upper board 28 in order to grasp and slide the boards within the housing 18. Preferably the boards are rectangular shaped and are narrower than the distance between the arms of a wheelchair.

Figure 2:
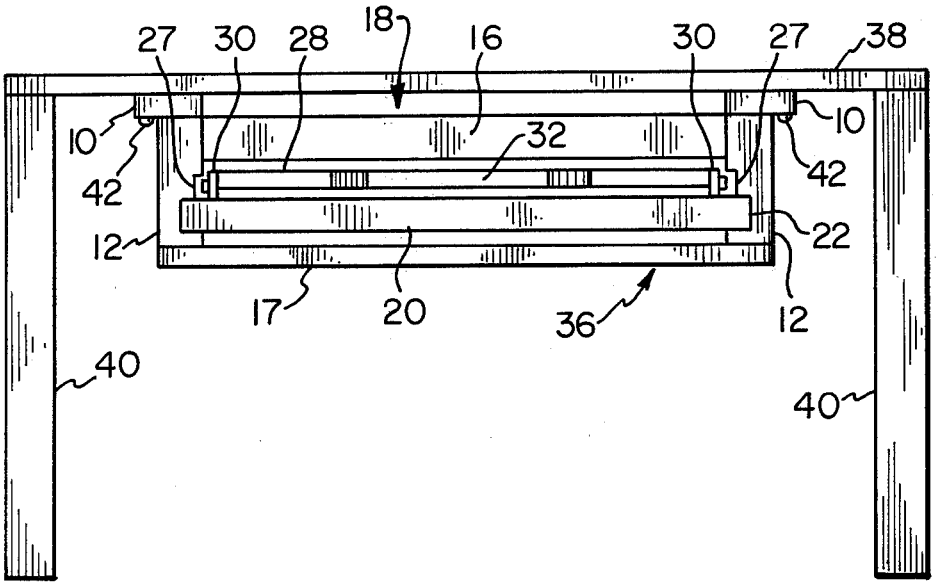
FIG. 2 is an elevation view of the table extension installed under a table.

FIG. 2 shows the table extension, indicated generally by item 36, with the housing 18 mounted beneath a standard table which includes a top 38 and legs 40, as viewed from one end of the table and in the collapsed position. The upper support members 10 are mounted to the underside of the table top 38 by fasteners such as screws 42 or adhesively. The boards 20, 28 are located between the frame members 12, beneath the cross supports 14 and 16 and above the lower support 17. The upper board 28 is mounted to the lower board 20 by a pair of Z-hinges 30. A second channel 27 is provided immediately above the first channel 26 in each frame member 12 to provide clearance for the Z-hinges 30 when the table extension is collapsed.

Figure 3:
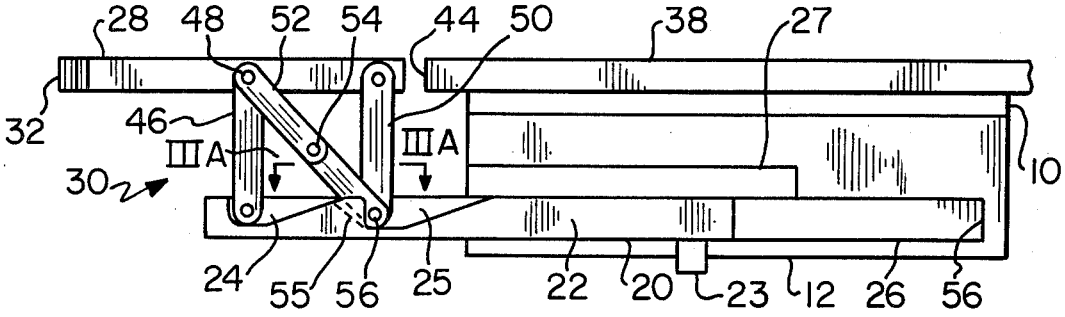
FIG. 3 is a side view of the table extension locked in its extended position.
Figure 3A:
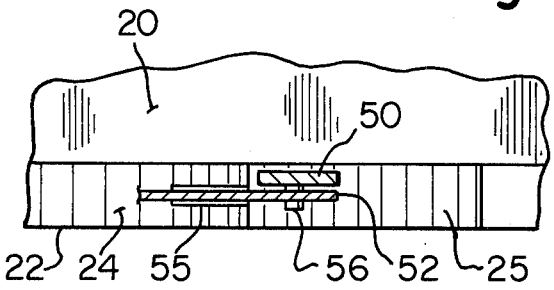
FIG. 3A is an enlarged section taken along lines IIIA—IIIA in FIG. 3.
Figure 4:
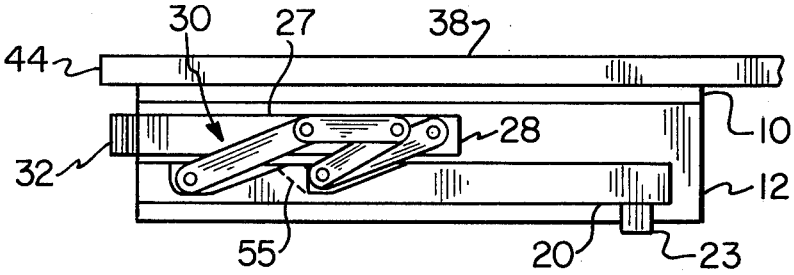
FIG. 4 is a side view of the table extension in its collapsed position.
Figure 5:
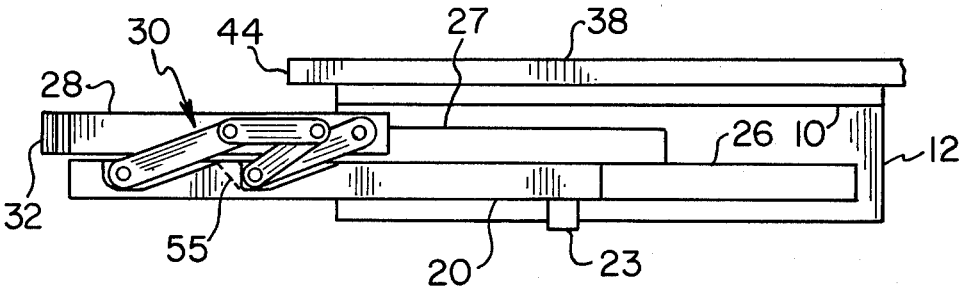
FIG. 5 is a side view of the table extension partially moved from underneath the table.

FIG. 3 shows the table extension underneath a table and in its extended position. For illustration purposes, this Figure, and also FIGS. 4 and 5, shows the table extension with one frame member 12, upper support member 10, the cross supports 14 and 16 and the lower support 17 removed. It is to be understood that the opposite side of the table extension is identical but of reverse hand to that shown in FIGS. 3, 4, and 5. The upper board 28 extends completely beyond a front edge 44 of the table top 38 and is positioned by the Z-hinges 30 at substantially table top level. The lower board 20 remains partially under the table supported by the channel 26 in each frame member 12. A stop 23 mounted beneath the lower board 20 prevents the boards from moving past the position where the stop 23 abuts the lower support 17 (not shown). Each Z-hinge 30 includes a front hinge arm 46 and a rear hinge arm 50, each pivotally mounted between the boards 20, 28. A middle hinge arm 52 is pivotally mounted between upper board front hinge pivot point 48 and lower board rear hinge pivot point 56. The middle hinge arm 52 pivots in its center at point 54 and may be locked in a rigid position by resting in a locking channel or ramp 55 in the lower board 20. It can be seen, by referring to FIGS. 3 and 3A, that when downward pressure is applied to the upper board 28 the middle hinge arm 52 pivots downward, but the locking ramp prevents further movement. Thus the Z-hinge 30 is supported in the extended position by the locking ramp 55. While the preferred locking hinge means is a Z-hinge in combination with the locking ramp 55, any collapsible hinge mechanism which can maintain the upper board 28 rigidly in its extended position, yet permit the upper board 28 to be moved immediately adjacent the lower board 20 when in the collapsed position, may also be used.

Along each side of the lower board 20 are first and second recessed portions 24 and 25 which provide room to mount the Z-hinge 30, but permit the hinge 30 to clear the inside of the frame members 12. The first hinge arm 46 is mounted to the lower board 20 in the first recessed portion 24 and the rear hinge arm 50 is mounted in the second recessed portion 25. The locking ramp 55 extends between the first and second recessed portions 24, 25 as shown in FIGS. 3, 3A, 4, and 5. The first channel 26 supports the lower board 20 along its outer edge 22 and permits the boards 20, 28 to be moved in and out of the housing 18. The first channel stops 56 near the end of the frame members 12 to prevent the lower board from being moved out the rear of the housing 18. The second channel 27 extends far enough to provide clearance for the Z-hinges 30 when the table extension is in its fully collapsed position within the housing 18.

The sequential operation of the table extension is illustrated by FIGS. 4, 5, and 3. When the extension is in its collapsed position as shown in FIG. 4, the extension can be "opened" by grasping and pulling outward on the handle 32, causing the boards 20, 28 to slide together from under the table top 38 as shown in FIG. 5. When the upper board 28 has completely passed the cross supports 14, 16 further pulling will cause the hinges 30 to rotate in an upward direction. The front and rear hinge arms 46, 50 rotate counterclockwise (with reference to the lower board 20) until they are substantially perpendicular with each board. The middle hinge arm 52 is supported in its rigid position by resting in the locking ramp 55 and prevents the front and rear hinge arms 46 and 50 from pivoting. Thus, the Z-hinges 30 will support the upper board 28 substantially on the same level as the table top 38 as shown in FIG. 3. When the table extension is in this extended position, the upper board 28 serves as the table top portion of the table extension. To return the table extension to its collapsed position, middle hinge arm is pivoted backwards, the upper board 28 is moved down adjacent to the lower board 20, and both boards are moved back under the table into the housing 18.

The table extension may easily be attached to an existing table by merely securing the unit underneath the table top by screws or other fasteners and requires no modification of the table. The table extension may also be built into a new table.

The Z-hinge 30 is preferably constructed of metal, and the remaining elements are constructed out of wood; however, any other satisfactory material may also be utilized. Furthermore, while the preferred use for this invention is as a table extension, it may also be used as an extension to any planar surface such as the top of a desk, work bench, counter or the like.

Having described presently the preferred embodiment of the invention, it is to be understood that it may be otherwise embodied within the scope of the appended claims.

I claim:

1. An extension adapted to be secured to the underside of a table top comprising:

a. a pair of opposed spaced side frame members forming a housing;

b. means for securing the housing to the underside of a table top;

c. a first planar member which extends transversely substantially between said side frame members;

d. support means in each side frame member for slidably supporting the first planar member;

e. a second planar member disposed above and substantially parallel to the first planar member; and f. locking hinge means connecting the planar members along their respective edges, said locking hinge means providing for movement of the planar members from a collapsed position within the housing wherein said second planar member is disposed between said side frame members to an extended position wherein the second planar member can be raised to a position substantially at the same level as the table top to provide an extension to the table top.

2. The extension set forth in claim 1 wherein the support means comprises a longitudinal channel in each frame member and an edge of the first planar member is engagable with one of the channels.

3. The extension set forth in claim 1 or claim 2 wherein the locking hinge means comprises a pair of opposed Z-hinges and locking means on the first planar member for locking the Z-hinges in an open position whereby the planar members are held in the extended position.

4. The extension set forth in claim 1 or claim 2 and including means for grasping and moving the planar members from the collapsed position to the extended position and vice versa.

5. The extension set forth in claim 4 wherein the means for grasping and moving the planar members is a handle secured to the second planar member.

6. The extension set forth in claim 1 or claim 2 and including at least one cross support member located between and connected to the side frame members.

7. The extension set forth in claim 1 or claim 2 wherein the means for securing the side frame members beneath the table top is an upper support member attached to the top of each side frame member.

8. An extension adapted to be secured to the underside of a table top comprising:

a. a pair of opposed spaced side frame members forming a housing;

b. an upper support member attached to the top of each side frame member for securing the housing to the underside of a table top;

c. a first planar member which extends transversely substantially between said side frame members;

d. a longitudinal channel in each side frame member which engages an edge of the first planar member for slidably supporting the first planar member within the housing;

e. a second planar member disposed above and substantially parallel to the first planar member;

f. a pair of opposed Z-hinges connected to the respective edges of and for moving the planar members from a collapsed position within the housing wherein said second planar member is disposed between said side frame members to an extended position wherein the second planar member can be raised to a position substantially at the same level as the table top to provide an extension to the table top.

g. locking means on the first planar member for locking the Z-hinges in their open position whereby the planar members are held in the extended position; and h. a handle secured to the second planar member for grasping and moving the planar members from the collapsed position to the extended position and vice versa.

9. In combination with a table including a table top and supporting legs, a table extension secured to the underside of the table top, said table extension comprising:

a. a pair of opposed spaced side frame members secured to the underside of the table top and forming a housing;

b. a first planar member which extends transversely substantially between said side frame members;

c. support means in each side frame member for slidably supporting the first planar member;

d. a second planar member disposed above and substantially parallel to the first planar member; and e. locking hinge means connecting the planar members along their respective edges, said locking hinge means providing for movement of the planar members from a collapsed position within the housing wherein said second planar member is disposed between said side frame members to an extended position wherein the second planar member can be raised to a position substantially at the same level as the table top to provide an extension to the table top.

10. The combination set forth in claim 9 wherein the support means comprises a longitudinal channel in each frame member and an edge of the first planar member is engagable with one of the channels.

11. The combination set forth in claim 9 or claim 10 wherein the locking hinge means comprises a pair of opposed Z-hinges and locking means on the first planar member for locking the Z-hinges in their open position whereby said planar members are held in the extended position.

12. The combination set forth in claim 9 or claim 10 and including means for grasping and moving the planar members from the collapsed position to the extended position and vice versa.

13. The combination set forth in claim 12 wherein the means for grasping and moving the planar members is a handle secured to the second planar member.

14. The combination set forth in claim 9 or claim 10 and including at least one cross support member located between and connected to the side frame members.

* * * * *